US006525755B1

(12) United States Patent
Imai et al.

(10) Patent No.: US 6,525,755 B1
(45) Date of Patent: Feb. 25, 2003

(54) THICK FILM THERMAL HEAD

(75) Inventors: Ryoichi Imai, Amimachi (JP); Junichi Terauchi, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/635,658

(22) Filed: Aug. 10, 2000

(30) Foreign Application Priority Data

Aug. 11, 1999 (JP) ..... 11-227328
Jul. 14, 2000 (JP) ..... 2000-214657

(51) Int. Cl.[7] ..... B41J 2/335
(52) U.S. Cl. ..... 347/208
(58) Field of Search ..... 347/200, 206, 347/202, 203, 208, 204; 101/114; B41I 2/335

(56) References Cited

U.S. PATENT DOCUMENTS 4,030,408 A 6/1977 Miwa
4,713,671 A 12/1987 Takoshima
5,072,236 A * 12/1991 Tatsumi et al. ..... 347/203

FOREIGN PATENT DOCUMENTS

| | | |
|---|---|---|
| JP | 60 198263 | 2/1986 |
| JP | 63-165153 | 7/1988 |
| JP | 83 165153 | 7/1988 |

* cited by examiner

*Primary Examiner*—N. Le
*Assistant Examiner*—K. Feggins
(74) *Attorney, Agent, or Firm*—Nixon Peabody LLP; Donald R. Studebaker

(57) ABSTRACT

A thick film thermal head includes a substrate which is provided with a linear groove and is heat-conductive at least at a part of the surface facing the groove. An elongated resistance heater is embedded in the groove to be in contact with the part of the surface of the substrate at which the substrate is heat-conductive, and a plurality of electrodes are formed on the surface of the substrate in contact with the resistance heater and arranged in the longitudinal direction of the resistance heater.

7 Claims, 6 Drawing Sheets

THICK FILM THERMAL HEAD

BACKGROUND OF THE INVENTION

1. Field of the Invention

This invention relates to a thick film thermal head which is employed to thermally perforate a stencil material to make a stencil to be used in an image forming apparatus such as a stencil printer.

2. Description of the Related Art

As the thermal head used in various image forming apparatuses, there have been known a thin film thermal head and a thick film thermal head. The former is formed by the use of thin film forming technique and the latter is formed by the use of technique other than the thin film forming technique. When perforating a heat-sensitive stencil material by the use of such a thermal head, it is required that adjacent perforations are clearly separated in order to obtain a high printing quality.

A thick film thermal head has been used in a heat-sensitive printing system and a ribbon transfer printing system. The thick film thermal head comprises an insulator substrate such as of ceramic, a plurality of electrodes formed on the substrate and a resistance heater formed on the electrodes. When power is supplied to the electrodes, the resistance heater generates heat from the lower surface thereof in contact with the electrodes and the heat propagates the resistance heater to the upper surface thereof where the resistance heater is brought into contact with a recording medium. In this thermal head, the resistance heater extends across the electrodes and the parts of the resistance heater between the electrodes form resistance heater elements, and each pixel of the image formed by the thermal head becomes larger than the heater element.

When the thick film thermal head is used for making a stencil, each of the perforations becomes too large since the heat generated from the lower surface of each of the resistance heater elements spreads over a wide area while the heat propagates to the upper surface of the heat element, and at the same time, it takes a long time for the temperature of the surface of each heater element to reach a perforating temperature, which results in poor response of the thermal head.

Further, in the case of a stencil printer, ink is apt to spread when transferred to the printing paper through the perforations of the stencil and is apt to form printing dots larger than the perforations of the stencil. Accordingly, the perforations of the stencil should be smaller by an amount corresponding to spread of the ink and should be discrete from each other. From this viewpoint, the aforesaid thermal head where heat is generated from the lower surface of the resistance heater elements is not suitable for making a stencil.

In a thermal head having a linear array of resistance heater elements extending in a main scanning direction (in the direction of width of a stencil), though the size of the perforations in the main scanning direction can be reduced by narrowing the intervals at which the electrodes are arranged, it is difficult to reduce the size of the perforations in the sub-scanning direction (the direction in which the stencil is conveyed) due to difficulties in narrowing the width of the resistance heater and influence of heat diffusion.

That is, conventionally, the thick film thermal head is formed by coating resistance heater paste by silk screening on electrodes b formed on a substrate a as shown in FIG. 14. Though the resistance heater paste forms a narrow protrusion as shown by chained line c immediately after coating, it is flattened in the sub-scanning direction with lapse of time as shown by the solid line d. This phenomenon occurs because the resistance heater paste is flowable and there is provided no member for limiting spread of the paste, and makes it difficult to form a narrow resistance heater.

As disclosed, for instance, in Japanese Unexamined Patent Publication No. 63(1988)-165153, there has been proposed a structure in which a heat accumulator layer is formed on an insulating substrate such as of ceramic, a resistance heater is embedded in a groove formed on the heat accumulator layer, and electrodes are formed over the resistance heater for the purpose of making each heat generating area larger than the resistance heater element corresponding thereto and making the pixels contiguous to each other. However this structure of a thermal head is not suitable for making a stencil. That is, when the thermal head is used for thermally perforating a heat-sensitive stencil material, heat generated by each resistance heater element accumulates in the heat accumulator layer and spreads wide, which can result in enlarged or connected perforations. Further the heat accumulator layer deteriorates the speed of response to heat (heat dissipating speed).

There has been known also a thick film thermal head in which a resistance heater in the form of a protrusion is formed on electrodes on a substrate. This type of thermal head is disadvantageous in that paper grounds or resin grounds is peeled off the stencil material by the protruding resistance heater when the stencil material is moved relative to the thermal head during stencil making. The paper grounds or the resin grounds adheres to the surface of the protruding resistance heater and adversely affects stencil making, e.g., prevents the resistance heater from being brought into a close contact with the stencil material and causes the resistance heater to fail in perforating the stencil material.

Due to the difficulties described above, a thin film thermal head has been generally employed for perforating a heat-sensitive stencil material. The thin film thermal head is advantageous in that the resistance heater is of a thin film and accordingly the heat generating area for each resistance heater element can be small, which results in small perforations. However, the thin film thermal head is disadvantageous in that its manufacturing cost is high. That is, the thin film thermal head is manufactured by the use of semiconductor manufacturing technology and expensive apparatuses such as a sputtering apparatus or a vacuum deposition apparatus and high technique are required. At the same time, materials for forming the thermal head are expensive. Further, the semiconductor manufacturing apparatuses are generally for making integral circuits and the like and are not able to produce a large size (e.g., for A2 or larger size) thermal head by one step. Accordingly, a large size thermal head must be produced by incorporating a plurality of small thermal head segments, which gives rise to a problem that heat generation becomes unsatisfactory at junctions between the segments, which can result in white stripes on prints.

To the contrast, the thick film thermal head can be made at low cost, for instance, by screen printing, and can be easily made in a large size.

SUMMARY OF THE INVENTION

In view of the foregoing observations and description, the primary object of the present invention is to provide a thick film thermal head which is improved in perforating properties. That is, the primary object of the present invention is to provide a thermal head which can be produced at low cost and in a large size and, at the same time, can form small discrete perforations in a heat-sensitive stencil material at high response to heat.

In accordance with the present invention, there is provided a thick film thermal head comprising a substrate which is provided with a linear groove on a surface thereof and is heat-conductive at least at a part of the surface facing the groove, an elongated resistance heater embedded in the groove to be in contact with the part of the surface of the substrate at which the substrate is heat-conductive, and a plurality of electrodes which are formed on the surface of the substrate in contact with the resistance heater and arranged in the longitudinal direction of the resistance heater.

It is preferred that the electrodes comprise alternate first and second electrodes and the parts of the elongated resistance heater between the first and second electrodes generate heat when electric power is applied across the first and second electrodes.

It is preferred that the substrate is of calcined aluminum oxide.

The substrate may be of a plurality of layers with at least one of the layers in contact with the resistance heater being heat-conductive. For example, the substrate may comprise a ceramic layer and one or more glass layers superposed on the ceramic layer.

The linear groove formed in the substrate may be rectangular, U-shaped, V-shaped or trapezoidal in cross-section. The linear groove may be formed, for instance, by the use of a processing machine such as a rotary stone or an industrial laser.

In the thick film thermal head in accordance with the present invention, since the resistance heater is embedded in the groove, the width of the resistance heater is limited to the width of the groove. Further, since the electrodes are in contact with the surface of the resistance heater which is brought into contact with the stencil material when making a stencil, heat is generated from the surface of the resistance heater which is brought into contact with the stencil material and applied to the stencil material before propagating over a large distance and spreading wide. Accordingly, with the thermal head of the present invention, perforations can be small even in the sub-scanning direction and the quality of the stencil can be improved so that the printing dots can be sufficiently small in size and the printing quality is improved. Further since being of a thick film type, the thermal head of the present invention can be produced at low cost without using a semiconductor manufacturing apparatus and can be produced in a large size. Accordingly, even a large size thermal head can be employed in printing without fear of generating a white stripe on prints.

Further, since heat which propagates toward the side walls and the bottom of the groove and does not contribute to perforation of the stencil material is dissipated through the heat-conductive part of the substrate, the thermal head of the present invention is increased in its response to heat and can be operated at a high speed.

DESCRIPTION OF THE PREFERRED EMBODIMENT

Figure 1:
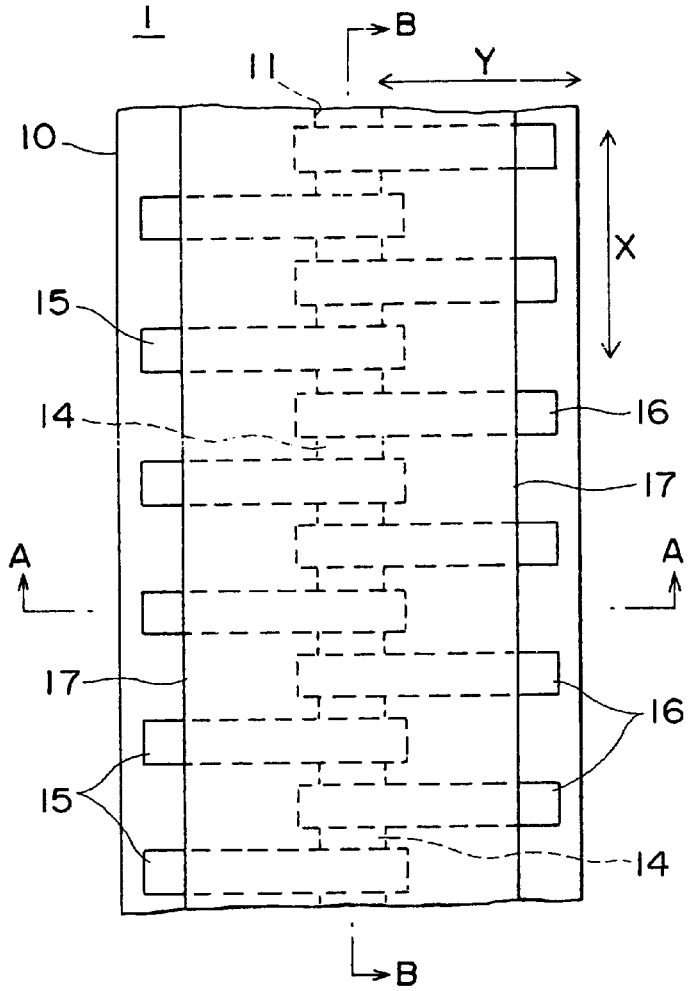
FIG. 1 is a fragmentary plan view of a thermal head in accordance with an embodiment of the present invention.
Figure 2:
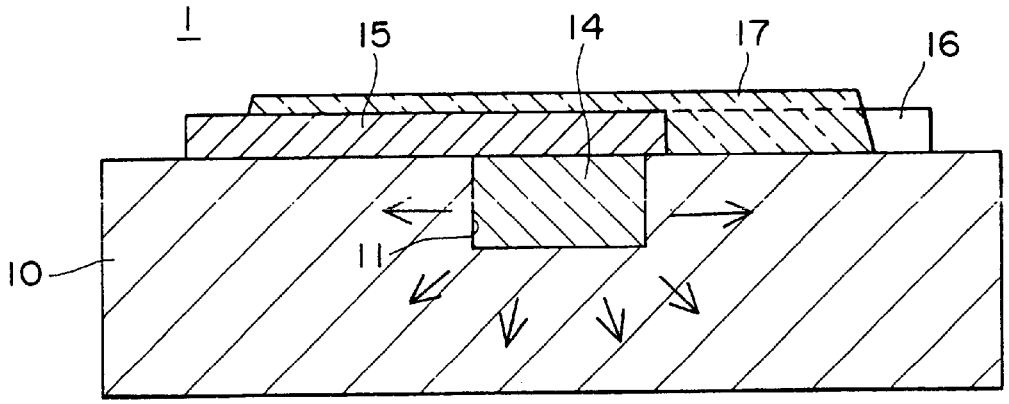
FIG. 2 is a cross-sectional view taken along line A—A in FIG. 1.
Figure 3:
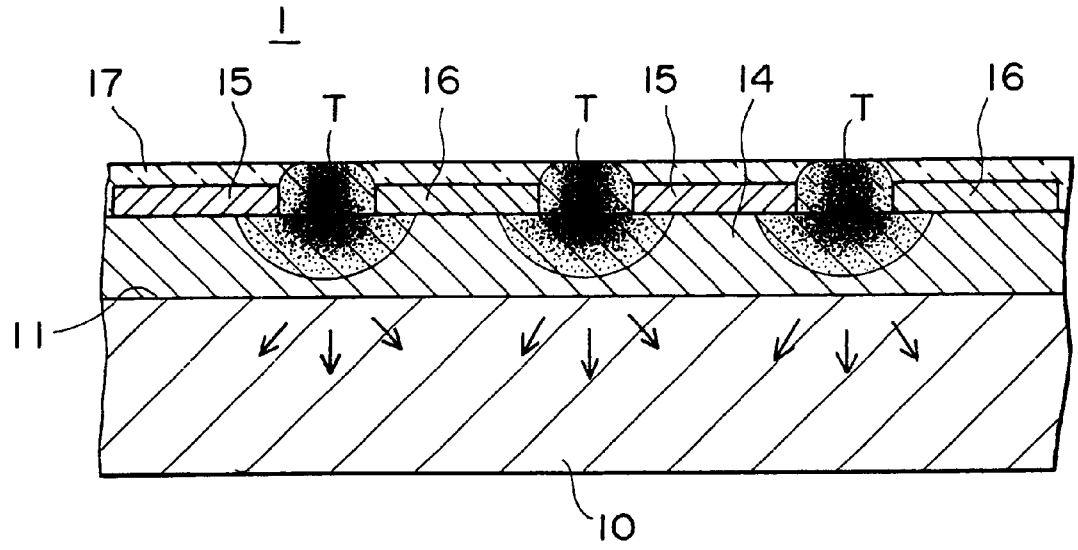
FIG. 3 is a cross-sectional view taken along line B—B in FIG. 1.

In FIGS. 1 to 3, a thick film thermal head 1 in accordance with an embodiment of the present invention comprises a substrate 10 which is formed of an electrical insulating and heat-conductive material such as calcined aluminum oxide. A linear groove 11 which is rectangular in cross-section is formed on the upper surface of the substrate 10 and an electrical conductive resistance heater 14 is embedded in the groove 11. First and second strip-like electrodes 15 and 16 are formed on the resistance heater 14 to extend across the resistance heater 14. The first and second electrodes 15 and 16 are alternately arranged in the longitudinal direction of the resistance heater 14. The first and second electrodes 15 and 16 are in contact with the resistance heater 14 at their one end portions and extend in opposite directions from their respective one end portions. A wear-resistant film (protective layer) 17 which is of glass or the like and has a flat upper surface is formed to cover the resistance heater 14 and the central portions of the first and second electrodes 15 and 16. The thermal head 1 of this embodiment is brought into contact with a stencil material at the upper surface of the wear-resistant film 17.

The linear groove 11 may be formed by, for instance, a rotary stone or an industrial laser.

The first and second electrodes 15 and 16 are connected to a control circuit (e.g., a driver IC) through wire bonding.

As shown in FIG. 3, when power is applied to the first and second electrodes 15 and 16, parts of the resistance heater 14 between the first and second electrodes 15 and 16 generates heat from the upper surface thereof. The heat T is transferred through the wear-resistant film 17 toward the upper surface thereof and thermally perforates the stencil material. (In FIG. 3, the parts where the density of black dots is high are high in temperature.) That is, each of the parts of the resistance heater 14 between the first and second electrodes 15 and 16 corresponds to one perforation and forms one resistance heater element. Further, as shown in FIGS. 2 and 3, the heat generated by the resistance heater 14 is transferred to the substrate 10 through the side surfaces and the bottom surface of the resistance heater 14 and dissipated.

As shown in FIG. 1, the longitudinal direction of the resistance heater 14 is the main scanning direction X corresponding to the direction of width of the stencil material and the direction perpendicular to the main scanning direction x is the sub-scanning direction Y corresponding to the direction in which the stencil material is conveyed.

Figure 4:
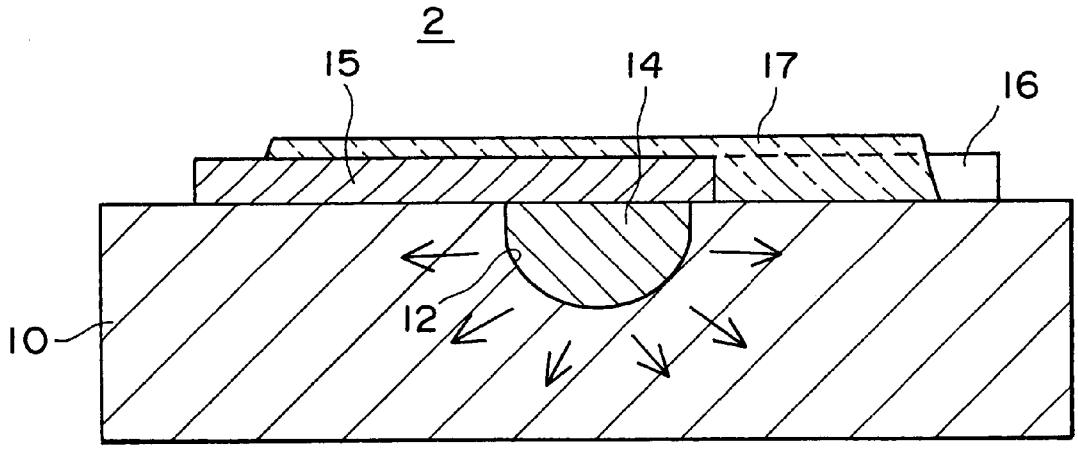
FIG. 4 is a cross-sectional view of a thermal head in accordance with another embodiment of the present invention which differs from the embodiment shown in FIG. 1 in the crosssectional shape of the linear groove.
Figure 5:
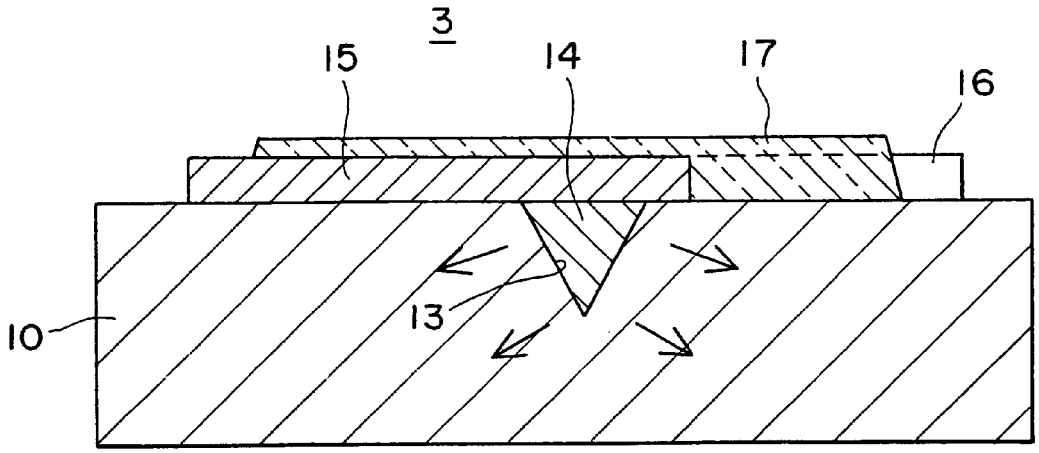
FIG. 5 is a cross-sectional view of a thermal head in accordance with still another embodiment of the present invention which differs from the embodiment shown in FIG. 1 in the cross-sectional shape of the linear groove.

Though the linear groove 11 is rectangular in cross-section in the embodiment described above, the linear groove may be U-shaped, V-shaped or trapezoidal in cross-section. FIGS. 4 and 5 respectively show thermal heads 2 and 3 in accordance with other embodiments of the present invention where linear grooves 12 and 13 are U-shaped and V-shaped in cross-section. The thermal heads 2 and 3 are the same as the thermal head 1 of the embodiment described above except the cross-sectional shape of the linear groove, and accordingly, the elements analogous to those shown in FIGS. 1 to 3 are given the same reference numerals and will not be described here. The thermal heads 2 and 3 are somewhat different from the thermal head 1 of the embodiment described above in heat dissipating characteristics shown by the arrows due to difference in the cross-sectional shape of the linear groove, i.e., the resistance heater.

Figure 6:
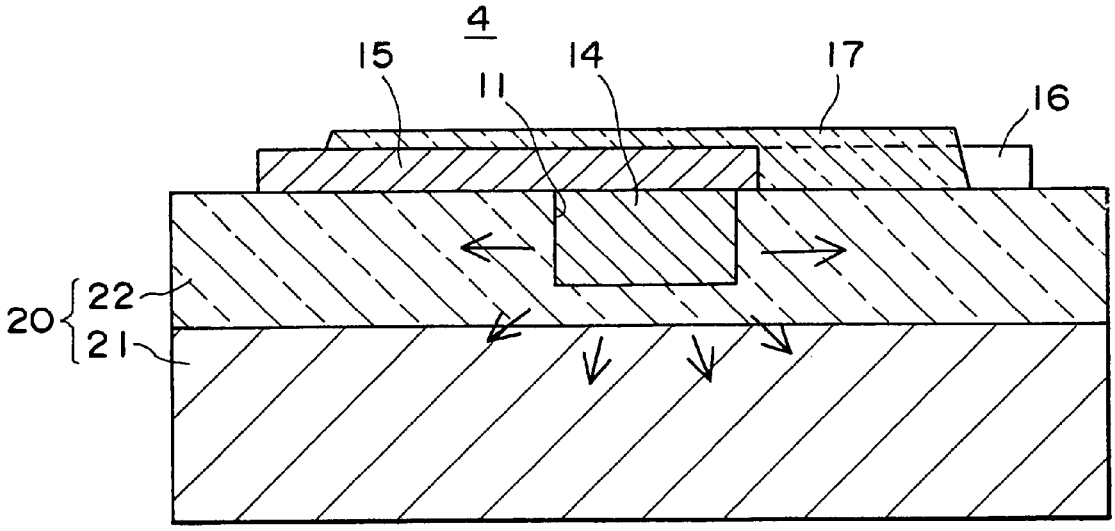
FIG. 6 is a cross-sectional view of a thermal head in accordance with still another embodiment of the present invention which differs from the embodiment shown in FIG. 1 in the structure of the substrate.

FIG. 6 shows a thermal head 4 in accordance with still another embodiment of the present invention where the structure of the substrate is different from that of the embodiment described above. That is, the thermal head 4 of this embodiment is provided with a substrate 20 formed of a heat-conductive ceramic layer 21 such as of calcined aluminum oxide and a glass layer 22. A linear groove 11 is formed on the surface of the glass layer 22 and a resistance heater 14 is embedded in the linear groove 11 as in the first embodiment. Further first and second electrodes 15 and 16 are formed on the resistance heater 14 and a wear-resistant film 17 is formed thereon as in the first embodiment. Heat generated by the resistance heater 14 is transferred from the resistance heater 14 to the ceramic layer 21 through the glass layer 22 and is dissipated as shown by the arrows in FIG. 6.

Figure 7:
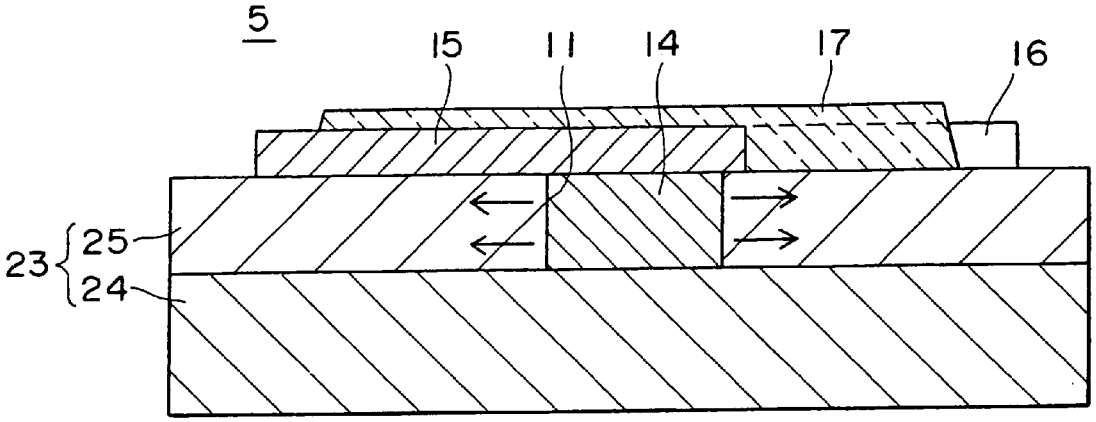
FIG. 7 is a cross-sectional view of a thermal head in accordance with still another embodiment of the present invention which differs from the embodiment shown in FIG. 1 in the structure of the substrate.

FIG. 7 shows a thermal head 5 in accordance with still another embodiment of the present invention where the structure of the substrate is different from that of the embodiment described above. That is, the thermal head 5 of this embodiment is provided with a substrate 23 formed of a base layer 24 and an upper layer 25 superposed on the base layer 24. The base layer 24 is of an electrical insulating material such as calcined ceramic, and the upper layer 25 is of a heat conductive material such as of calcined aluminum oxide. A linear groove 11 is formed in the upper layer 25 to reach the base layer 24 and a resistance heater 14 is embedded in the linear groove 11 as in the first embodiment. Further first and second electrodes 15 and 16 are formed on the resistance heater 14 and a wear-resistant film 17 is formed thereon as in the first embodiment. Heat generated by the resistance heater 14 is mainly transferred to the upper layer 25 through the side surfaces of the resistance heater 14 and is dissipated as shown by the arrows in FIG. 7.

Figure 8:
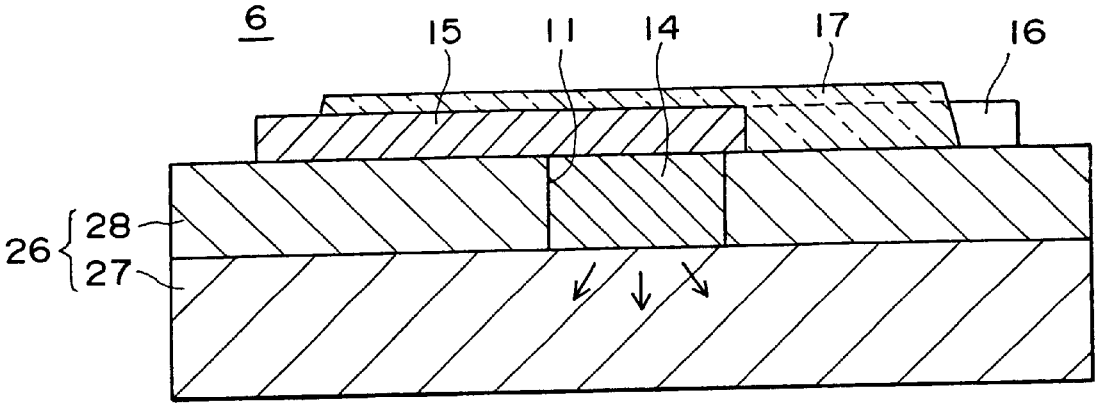
FIG. 8 is a cross-sectional view of a thermal head in accordance with still another embodiment of the present invention which differs from the embodiment shown in FIG. 1 in the structure of the substrate.

FIG. 8 shows a thermal head 6 in accordance with still another embodiment of the present invention where the structure of the substrate is different from that of the embodiment described above. That is, the thermal head 6 of this embodiment is provided with a substrate 26 formed of a base layer 27 and an upper layer 28 superposed on the base layer 27. The base layer 27 is of a heat conductive material such as of calcined aluminum oxide, and the upper layer 28 is of an electrical insulating material such as calcined ceramic. A linear groove 11 is formed in the upper layer 28 to reach the base layer 27 and a resistance heater 14 is embedded in the linear groove 11 as in the first embodiment. Further first and second electrodes 15 and 16 are formed on the resistance heater 14 and a wear-resistant film 17 is formed thereon as in the first embodiment. Heat generated by the resistance heater 14 is mainly transferred to the base layer 27 through the bottom surface of the resistance heater 14 and is dissipated as shown by the arrows in FIG. 8.

An example of manufacturing steps of the thermal head 1 shown in FIGS. 1 to 3 will be described with reference to FIGS. 9 to 13, hereinbelow. The manufacturing steps basically comprise the steps of forming the linear groove 11 on the substrate 10, embedding the resistance heater 14 in the groove 11, forming the electrodes 15 and 16 by forming metal film over the substrate 10 and photo-etching the metal film into electrodes, and forming the wear-resistant film 17.

Figure 9:
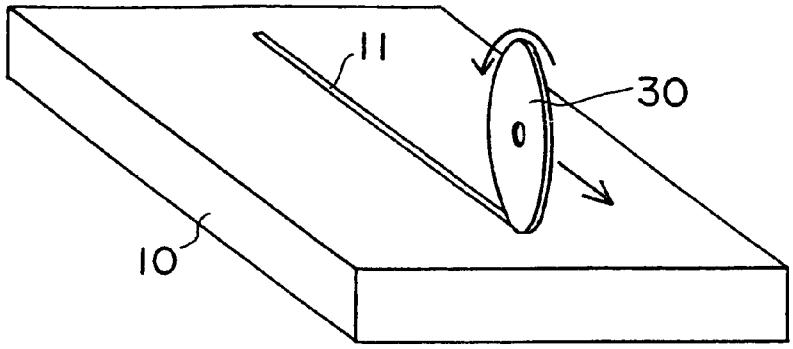
FIGS. 9 to 13 are views for illustrating an example of manufacturing steps of the thermal head.

A calcined aluminum oxide (alumina) substrate 10 of a predetermined thickness is first prepared and a linear groove 11 is formed on the surface of the substrate 10 as shown in FIG. 9. The linear groove 11 is formed by the use of, for instance, a grinder having a rotary stone 30 which is shaped to conform to a desired cross-sectional shape of the groove 11. When the groove 11 is formed in a width of 20 to 50 $\mu$m, a thermal head having a resolution of 400 dpi can be obtained. The depth of the groove 11 is suitably 20 to 80 $\mu$m. The grooves 12 and 13 of different cross-sectional shapes may be substantially the same in width and depth.

A super-thin rotary diamond cutter (e.g., a rotary blade in NBC series from Disco Corporation) for cutting semiconductor wafers and the like may be used for forming the groove 11. Further, the groove 11 may be formed by the use of an industrial laser such as an YAG laser or may be chemically formed by etching. When the substrate 10 is to be formed by baking aluminum oxide powder, the groove 11 may be formed by baking a block of aluminum oxide powder after forming a groove by stamping.

Figure 10:
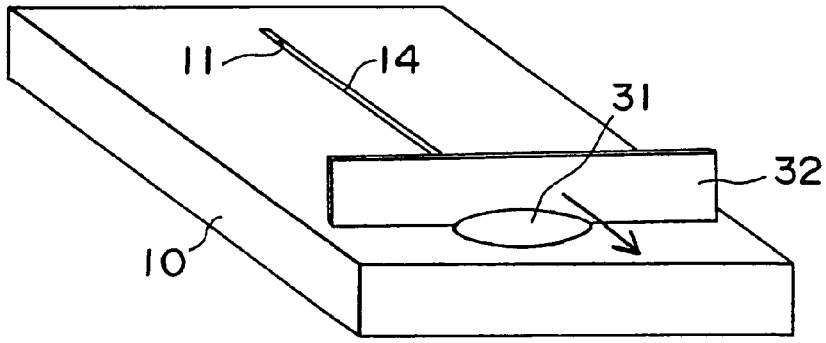

Then paste 31 for forming the resistance heater 14 is filled in the linear groove 11 by a squeegee 32 as shown in FIG. 10. Then the paste 31 is baked and solidified, thereby forming the resistance heater 14. Though ruthenium oxide paste is suitable for the paste 31, electrical conductive carbon paste may be used. The material of the paste 31 and the aluminum oxide for forming the substrate 10 should match each other in bonding strength and coefficient of thermal expansion so that crack is not produced by heat.

Figure 11:
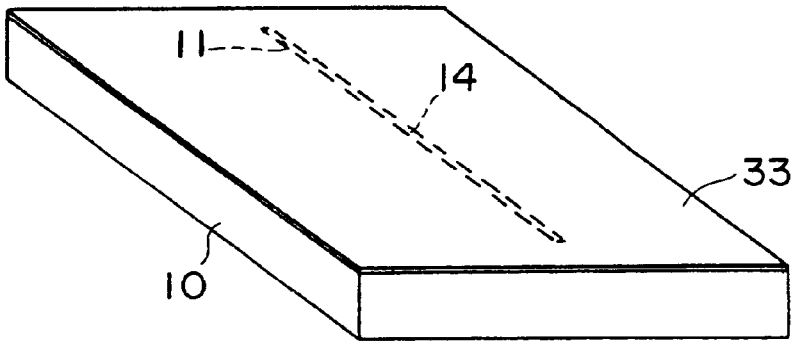

Thereafter metal film 33 of paste of gold or other metal for forming the electrodes 15 and 16 is formed over the entire upper surface of the substrate 10 including the upper surface of the resistance heater 14 by silk screening as shown in FIG. 11. The metal film 33 is subsequently heated to be fixed.

Figure 12:
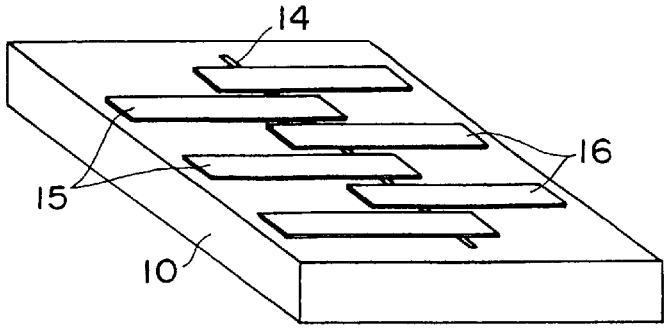

Then photoresist is coated over the fixed metal film 33 and is exposed to light in a pattern of the electrodes 15 and 16. Then the photoresist is developed and removed to expose the metal film 33 except the parts corresponding to the electrodes 15 and 16. The exposed part of the metal film 33 is removed by etching with the part covered with the photoresist left there, whereby the first and second electrodes 15 and 16 are formed in a predetermined pattern as shown in FIG. 12.

Figure 13:
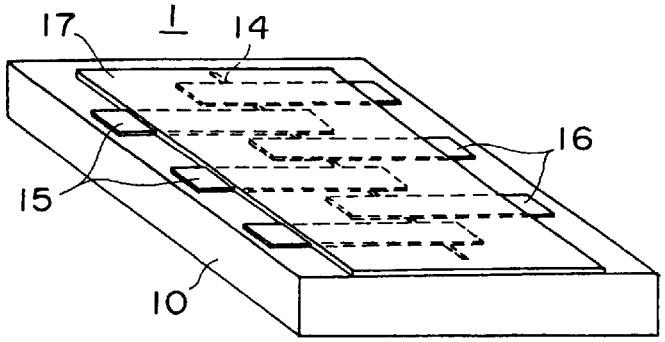
Figure 14:
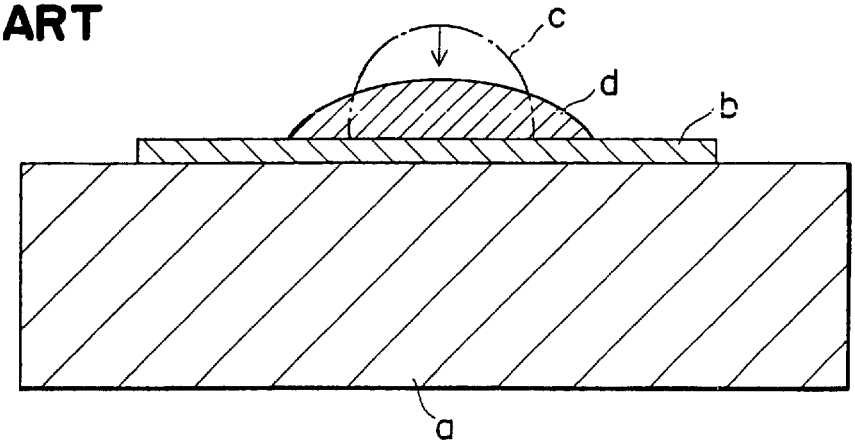
FIG. 14 PRIOR ART
FIG. 14 is a cross-sectional view showing formation of the resistance heater in a conventional thick film thermal head.

Thereafter, a glass composition is coated over the resistance heater 14 and the electrodes 15 and 16 with the outer end portions of the electrodes 15 and 16 exposed as shown in FIG. 13, and is heated to form the wear-resistant film 17, thereby obtaining a thermal head 1.

A driver IC is mounted and wire bonding step is carried out on the thermal head 1 thus obtained before the thermal head 1 is incorporated in a stencil making section of a stencil printer.

In the embodiment shown in FIG. 6 where the substrate 20 is formed of the ceramic layer 21 and the glass layer 22 and the linear groove 11 is formed on the glass layer 22, the linear groove 11 is relatively easily processed due to a low hardness of the glass layer 22.

In the thick film thermal heads in accordance with the embodiments described above, since the electrodes 15 and 16 are in contact with the surface of the resistance heater 14 which is brought into contact with the stencil material when making a stencil, heat is generated from the surface of the resistance heater 14 which is brought into contact with the stencil material and applied to the stencil material before propagating over a large distance and spreading wide. Accordingly, perforations can be small in size and resolution of the stencil can be improved, and at the same time, response to heat of the thermal head is improved. Further since being of a thick film type, the thermal heads can be produced at low cost without using a semiconductor manufacturing apparatus and can be produced in a large size.

Further, since the resistance heater 14 is in contact with the substrate 10, the glass layer 22, the upper layer 25 or the base layer 27 having a high thermal conductivity, heat generated by the resistance heater 14 is constantly dissipated and the heat generating areas cannot spread wide.

Further, since the resistance heater 14 is embedded in the groove 11, 12 or 13, the width of the resistance heater 13 is limited to the width of the groove, whereby the heat generating areas can be confined narrow also in the sub-scanning direction and the size of the perforations can be small also in the sub-scanning direction and the size of the perforations can be small also in the sub-scanning direction. Further since the thermal heads of the embodiments described above are flat at the surface to be brought into contact with the stencil material, resin grounds cannot be generated during perforation of the stencil material.

In addition, all of the contents of Japanese Patent Application Nos. 11(1999)-227328 and 2000-214657 are incorporated into this specification by reference.

What is claimed is:

1. A thick film thermal head for thermally perforating a heat sensitive stencil material, comprising:

a substrate which is provided with a linear groove on a surface thereof and is heat-conductive at least at a part of the surface of the substrate which faces the groove to thereby allow heat dissipation through the heat-conductive part of the substrate;

an elongated resistance heater embedded in the groove to be in contact with the part of the surface of the substrate at which the substrate is heat-conductive; and a plurality of electrodes which are formed on the surface of the substrate in contact with the resistance heater and arranged in the longitudinal direction of the resistance heater.

2. A thick film thermal head as defined in claim 1, wherein the electrodes comprise alternate, spaced first and second electrodes, and parts of the elongated resistance heater located between the first and second electrodes generate heat when electric power is applied across the first and second electrodes, each of the parts forming a resistance heater element and a single perforation on the stencil material.

3. A thick film thermal head as defined in claim 1, wherein the substrate is of calcined aluminum oxide.

4. A thick film thermal head as defined in claim 1, wherein the substrate is formed of a plurality of layers with at least one of the layers in contact with the resistance heater being heat-conductive.

5. A thick film thermal head as defined in claim 4, wherein the substrate comprises a ceramic layer and one or more glass layers superposed on the ceramic layer.

6. A thick film thermal head as defined in claim 1, wherein the linear groove has a U-shaped cross-section.

7. A thick film thermal head as defined in claim 1, wherein the linear groove has a V-shaped cross-section.

* * * * *